US006830604B2

(12) United States Patent
Grearson et al.

(10) Patent No.: US 6,830,604 B2
(45) Date of Patent: Dec. 14, 2004

(54) TOOL FOR DRILLING/ROUTING OF PRINTED CIRCUIT BOARD MATERIALS

(75) Inventors: Alistair Grearson, West Midlands (GB); John Aucote, Warks (GB)

(73) Assignee: Sandvik AB, Sandviken (SE)

( * ) Notice: Subject to any disclaimer, the term of this patent is extended or adjusted under 35 U.S.C. 154(b) by 206 days.

(21) Appl. No.: 10/278,073

(22) Filed: Oct. 23, 2002

(65) Prior Publication Data

US 2003/0047031 A1 Mar. 13, 2003

Related U.S. Application Data

(62) Division of application No. 09/486,586, filed as application No. PCT/SE98/01574 on Sep. 4, 1998, now Pat. No. 6,521,172.

(30) Foreign Application Priority Data

Sep. 5, 1997 (SE) ..... 9703204

(51) Int. Cl.[7] ..... C22C 1/10
(52) U.S. Cl. ..... 75/236
(58) Field of Search ..... 75/232, 236

(56) References Cited

U.S. PATENT DOCUMENTS

| | | | | |
|---|---|---|---|---|
| 3,994,716 A | | 11/1976 | Huppmann et al. | |
| 4,093,450 A | | 6/1978 | Doyle et al. | |
| 4,469,505 A | | 9/1984 | Cheresnowsky et al. | |
| 4,539,041 A | | 9/1985 | Figlarz et al. | |
| 4,574,011 A | | 3/1986 | Bonjour et al. | |
| 5,476,531 A | | 12/1995 | Timm et al. | |
| 5,482,530 A | | 1/1996 | Höhne | |
| 5,603,075 A | | 2/1997 | Stoll et al. | |
| 5,658,678 A | | 8/1997 | Stoll et al. | |
| 5,802,955 A | | 9/1998 | Stoll et al. | |
| 6,015,447 A | | 1/2000 | Görge et al. | |
| 6,086,980 A | * | 7/2000 | Foster et al. | 428/212 |
| 6,413,293 B1 | * | 7/2002 | Grearson et al. | 75/240 |
| 6,521,172 B2 | * | 2/2003 | Grearson et al. | 419/18 |

FOREIGN PATENT DOCUMENTS

| | | |
|---|---|---|
| AT | 268706 | 2/1969 |
| DE | 2 225 896 | 12/1972 |
| DE | 27 19 532 | 11/1977 |
| GB | 622041 | 4/1949 |
| GB | 1309634 | 3/1973 |
| WO | 92/13112 | 8/1992 |
| WO | 92/18656 | 10/1992 |

OTHER PUBLICATIONS

V. A. Tracey et al., "Development of Tungsten Carbide–Cobalt–Ruthenium Cutting Tools for Machining Steels", vol. 82, No. 1, 1998, XP000574252, pp. 281–292.

B. Zetterlund, "Cemented Carbide in High Pressure Equipment", *High Pressure Engineering*, vol. 2, 1997, pp. 35–40.

* cited by examiner

*Primary Examiner*—Daniel Jenkins
(74) *Attorney, Agent, or Firm*—Burns, Doane, Swecker & Mathis, L.L.P.

(57) ABSTRACT

A dense cemented carbide product is described. The product is manufactured from WC with a grain size between 0.1 and 0.4 μm, fine grain size cobalt and ruthenium powders. The product is used in PCB machining operations where the addition of 10–25% Ru to the binder phase offers up to 25% wear resistant increases and up to 100% increase in chipping resistance in PCB routing compared to conventional materials (6% cobalt and 0.4 μm grain size).

5 Claims, No Drawings

TOOL FOR DRILLING/ROUTING OF PRINTED CIRCUIT BOARD MATERIALS

This Application is a Divisional Application of Ser. No. 09/486,586 filed 15 May 2000, now U.S. Pat. No. 6,521,172 which is a 371 of PCT/SE98/01574 filed 4 Sep. 1998.

The present invention relates to a tool for drilling/routing of printed circuit board materials. By alloying the binder phase with Ru in combination with the use of fine grained Co-powder the properties have been improved.

Cemented carbide containing Ru as binder phase alone or in combination with the conventional Co and/or Ni is known in the art. For example, AT 268706 discloses a hard metal with Ru, Rh, Pd, Os, Ir, Pt and Re alone or in combination as binder phase. U.S. Pat. No. 4,574,011 discloses a hard metal composition for ornamental purposes with a binder phase of Co, Ni and Ru. GB 1309634 discloses a cutting tool with a Ru binder phase. GB 622041 discloses a hard metal composition a Co+Ru binder phase.

The routing of Printed Circuit Board materials requires a wide range of properties from the tool material in order for it to perform successfully. These include a hardness in excess of 2000 HV, a resistance to edge chipping that is best defined by a fracture toughness in excess of 8 $MPam^{1/2}$, a resistance to chemical attack from the resins included in printed circuit boards and a sharp as possible a cutting edge. Some of these requirements conflict, for instance the high hardness tends to mean a reduced edge toughness. The new products for this application can, therefore, require a reduced WC grain size to produce a higher hardness with reduced toughness. However, if this is combined with an increase in cobalt content an increased toughness can be achieved for the same hardness. This also results in a sharper cutting edge, which is required.

The invention is primarily concerned with the addition of ruthenium to submicron grades of cemented carbide. The levels of addition vary between 5 and 35, preferably between 15 and 30, wt-% of the binder content with the best results obtained at about 25 wt-%. For best effects the cobalt used should be of the fine grain size cobalt powder having deagglomerated spherical grains of about 0.4 $\mu$m average grain size and with a narrow grain size distribution. Preferably the cobalt powder is polyol cobalt. The cobalt contents to which this addition can be made should vary from 5–12%, preferably 5–8. The average WC grain size shall be <0.8 $\mu$m, preferably <0.4 $\mu$m. The cemented carbide of the invention is preferably a straight WC+Co grade but it may also contain <5 wt-% gammaphase.

In order to obtain the submicron WC grain size $VC+Cr_3C_2$ is added. Because the Ru also acts as a mild grain growth inhibitor an addition of <0.9 wt % $VC+Cr_3C_2$ is generally satisfactory. Particularly good results are obtained if the $VC/Cr_3C_2$ ratio in wt % is 0.2–0.9, preferably 0.4–0.8, most preferably 0.6–0.7. Preferably sintering is performed using gas pressure sintering also referred to as sinter-HIP.

The invention also relates to the use of a cemented carbide with submicron WC grain size and with a binder phase containing 10–30 wt-% Ru as a tool for drilling/routing of printing circuit board materials.

The present invention further relates to a method of making a cemented carbide body comprising one or more hard constituents and a binder phase based on cobalt, nickel and/or iron by powder metallurgical methods milling pressing and sintering of powders forming hard constituents and binder phase whereby said binder phase contains 10–30 wt-% Ru. At least part of the binderphase powder consists of non agglomerated particles of spheroidal morphology of about 0.4 $\mu$m average grain size and with a narrow grain size distribution wherein at least 80% of the particles have sizes in the interval x±0.2x provided that the interval of variation (that is 0.4x) is not smaller than 0.1 $\mu$m.

The advantages offered by the ruthenium additions are as mentioned a further element of grain growth refinement, an increase in resistance to chemical attack and a strengthening of the binder phase without significantly affecting the edge toughness due to the increase in cobalt content used.

EXAMPLE 1

Cemented carbide PCB-router according to the invention were made with the composition 1.9% Ru, 5.6% Cobalt the remainder, WC (0.2 $\mu$m grain size), with about 0.7% ($VC+Cr_3C_2$) grain growth inhibitor. The material had a hardness of 2080 HV and a K1C of 8.75 $MPam^{1/2}$.

For comparison the following PCB routers according to prior art were also made. One was 6% cobalt grade with 0.4 $\mu$m WC with a hardness of 2000–2100 HV and one with the same hardness but with 5% cobalt and 0.5 $\mu$m WC grain size.

The routers were ground to 2.4 mm dia and tested as follows:

Workmaterial: Copper clad 3 mm thick FR4 PCB, stacked three deep

Test 1: 30,000 RPM, 1.2 m/min feedrate, 150 m of cut

Test 2: 42,000 RPM, 2.2 m/min feedrate, 100 m of cut

In test 1 routers according to the invention reached 150 m of cut with 25% less average wear than the prior art routers which used 6% cobalt.

In test 2 routers according to the invention reached 100 meters of cut with acceptable levels of wear.

Routers according to prior art with 5% and 6% cobalt both fractured between 50 and 75 meters.

EXAMPLE 2

2.4 mm dia routers according to the invention were made from cemented carbides with varying ruthenium contents as follows:

Composition 1: 1.0% Ru, 6.3% Co, 0.7 $VC+Cr_3C_2$, 0.2 $\mu$m WC

Composition 2: 1.4% Ru, 6.0% Co, 0.7 $VC+Cr_3C_2$, 0.2 $\mu$m WC

Composition 3: 1.9% Ru, 5.6% Co, 0.7 $VC+Cr_3C_2$, 0.2 $\mu$m WC

The routers were tested as follows:

Workmaterial: Copper clad 3 mm thick FR4 PCB, stacked three deep

Conditions: 30,000 RPM, 1.2 m/min feed rate.

Machining until fracture.

Results:

1.0% Ru variant—205 m (Average of 4 cutters)

1.4% Ru variant—333 m (Average of 5 cutters)

1.9% Ru variant—366 m (Average of 7 cutters)

EXAWMPLE 3

Cemented carbide PCB microdrills according to the invention were made with the composition 2.2% Ru, 6.4% Co the remainder WC (0.4 $\mu$m grain size), with about 0.8 % ($VC+Cr_3C_2$) grain growth inhibitor. The material had a hardness of 2001 HV and a K1C of 8% $MPam^{1/2}$.

For comparison the following PCB microdrills according to prior art were made using 8% cobalt grade with 0.4 $\mu$m WC with a hardness of 1900 HV.

The microdrills were tested and the wear measured. It was found that the prior art materials exhibited 10–15% less wear resistance and 10–15% less resistance to breakage during an increasing feed rate that started at 15 $\mu$m/rev and increasing towards 70.

What is claimed is:

1. Cemented carbide comprising 5–12% Co binder phase, VC in an amount greater than zero, $Cr_3C_2$ in an amount greater than zero, such that VC+$Cr_3C_2$ is in an amount greater than zero and less than 0.9 wt. %, and remainder submicron WC wherein said binder phase further contains 10–30 wt-% Ru.

2. Cemented carbide according to claim 1, wherein the binder phase content is 5–8 wt-%.

3. Cemented carbide according to claim 1, wherein said binder phase further contains about 25 wt-% Ru.

4. A machining tool comprising cemented carbide with submicron WC grain size and with 5–12% Co binder phase containing 10–30 wt-% Ru, and VC in an amount greater than zero, $Cr_3C_2$ in an amount greater than zero, such that VC+$Cr_3C_2$ is in an amount greater than zero and less than 0.9 wt. %.

5. Cemented carbide according to claim 1, wherein the ratio of wt. % defined VC/$Cr_3C_2$ is 0.2–0.9.

* * * * *